US006966437B1

(12) United States Patent
Bobrow

(10) Patent No.: US 6,966,437 B1
(45) Date of Patent: Nov. 22, 2005

(54) CONSTRUCTIVE DEVICE FOR PACKAGING UNDERWEAR

(75) Inventor: Claudio Bobrow, Sao Paulo (BR)

(73) Assignee: IMB Textil LTDA, Sao Paulo (BR)

( * ) Notice: Subject to any disclaimer, the term of this patent is extended or adjusted under 35 U.S.C. 154(b) by 0 days.

(21) Appl. No.: 11/024,781

(22) Filed: Dec. 30, 2004

(30) Foreign Application Priority Data

Apr. 29, 2004 (BR) ..... 8401000 U

(51) Int. Cl.[7] ..... B65D 85/18
(52) U.S. Cl. ..... 206/294; 206/292; 206/486
(58) Field of Search ..... 206/278, 279, 206/282–287, 292–297, 476–483, 485–487, 206/497, 525, 525.1; 2/239, 300; 229/87.1, 229/87.15, 87.17

(56) References Cited

U.S. PATENT DOCUMENTS 2,063,607 A * 12/1936 Kendig ..... 229/87.17
2,962,157 A * 11/1960 Meister ..... 206/278
2,974,837 A * 3/1961 Boehmer ..... 206/292
3,063,554 A * 11/1962 Gerard ..... 206/297
5,344,003 A * 9/1994 Park ..... 206/482
5,961,033 A * 10/1999 Wang ..... 206/294
6,622,858 B1 * 9/2003 Wilkinson et al. ..... 206/299

* cited by examiner

*Primary Examiner*—Luan K. Bui
(74) *Attorney, Agent, or Firm*—Greenblum & Bernstein, P.L.C.

(57) ABSTRACT

A constructive device for packaging underwear includes a cardboard or some other appropriate laminate, and a plastic cover that envelops the cardboard including the product fixed to it. The cardboard is divided into two sections that are configured to fold (one over the other) along a folding line. The sections of the cardboard define a top cover and a lower back cover. The back cover has a set of cutouts that create openings for introducing and fastening the two sides of the underwear V, including its mid-lower part, being that the clothing mentioned can be a panty; The cardboard is assembled inside the plastic cover such a way as to almost entirely cover both surfaces (inner and outer) of each of the sections.

1 Claim, 3 Drawing Sheets

CONSTRUCTIVE DEVICE FOR PACKAGING UNDERWEAR

This descriptive report discusses a Utility Model patent referring to a constructive device introduced in packaging especially intended for packing underwear, especially panties, men's underpants and similar items, said packaging having an unprecedented structure, giving the product to be packed inside it (panties or men's underpants) a totally innovative display quality.

As is widely known, underwear like panties or men's underpants are usually provided to the consuming public duly packed in packages that are almost always defined by a generic type of plastic wrapping or similar.

Although this type of packaging is widely used, it does not have a structure that adequately favors the product's display so to speak.

In view of this inconvenience, this constructive device introduced in packaging for underwear was developed, which presents a constructive solution that provides a more effective viewing of the product, giving the product an innovative quality from the market point of view.

The packaging discussed herein can be clearly observed in the figures below, where:

According to what is shown in the above listed figures, the packaging for underwear object of this utility model patent is characterized by the fact that it comprises two basic elements: a) a cardboard or some other appropriate laminate; and b) a plastic cover that envelops the cardboard including the product fixed to it.

In the figures portraying this utility model patent, the cardboard is generally indicated by the reference number 1, while the plastic cover is indicated by reference number 2.

Figure 1:
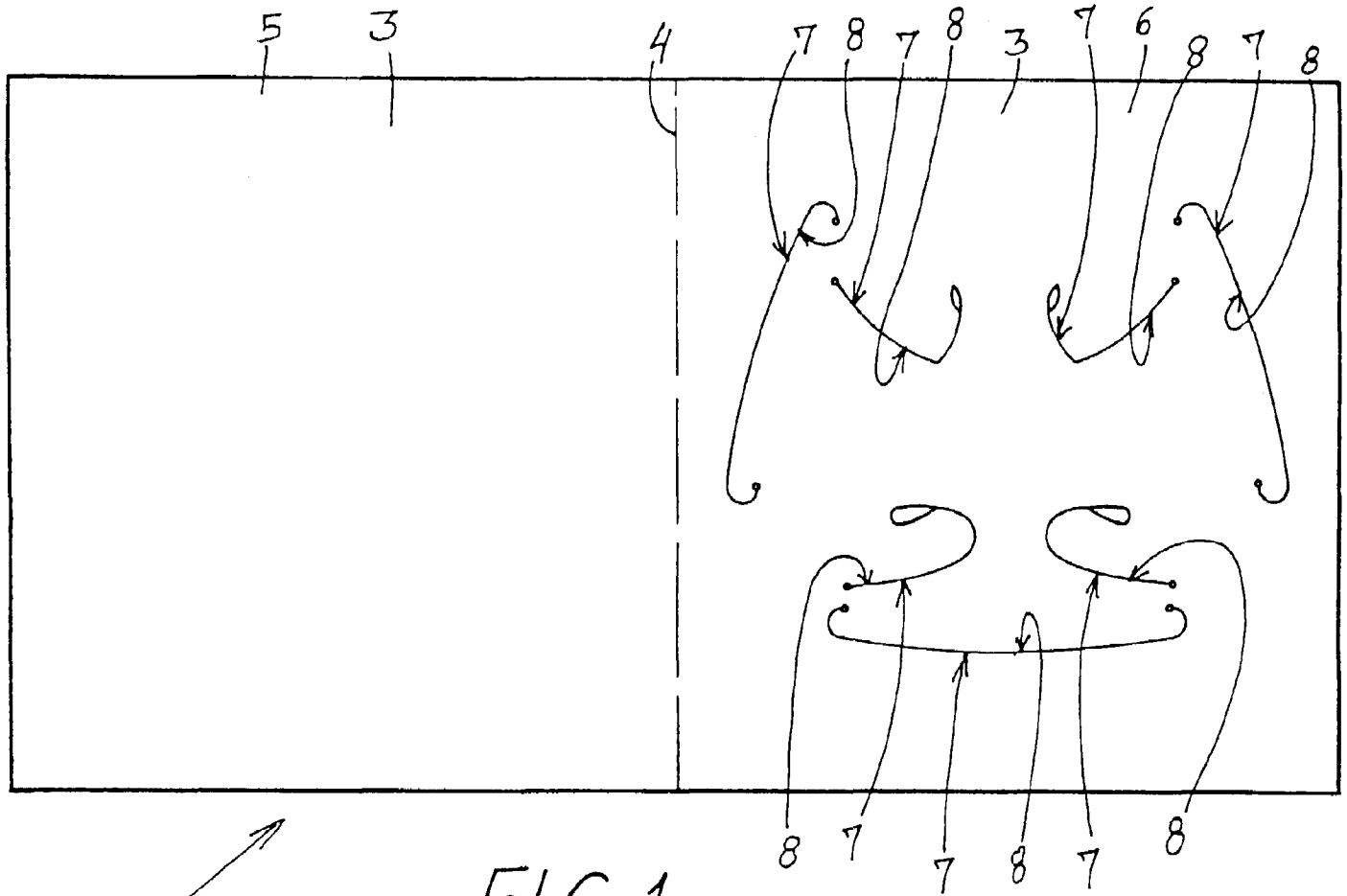
FIG. 1 shows a plane view of the laminar structure of the packaging in question.
Figure 2:
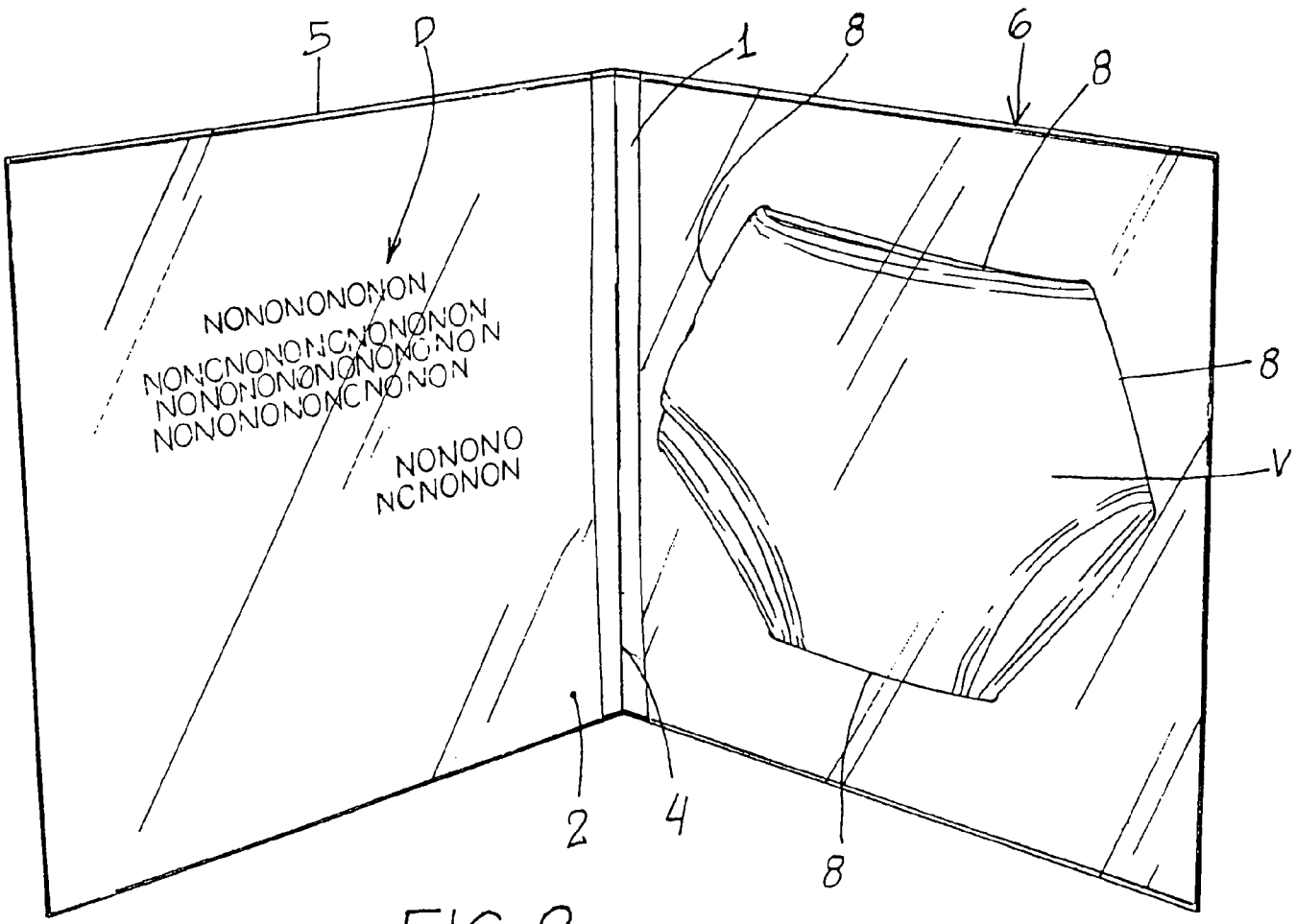
FIG. 2 shows a view of the fully assembled packaging and with an example of a panty duly packed inside it.
Figure 3:
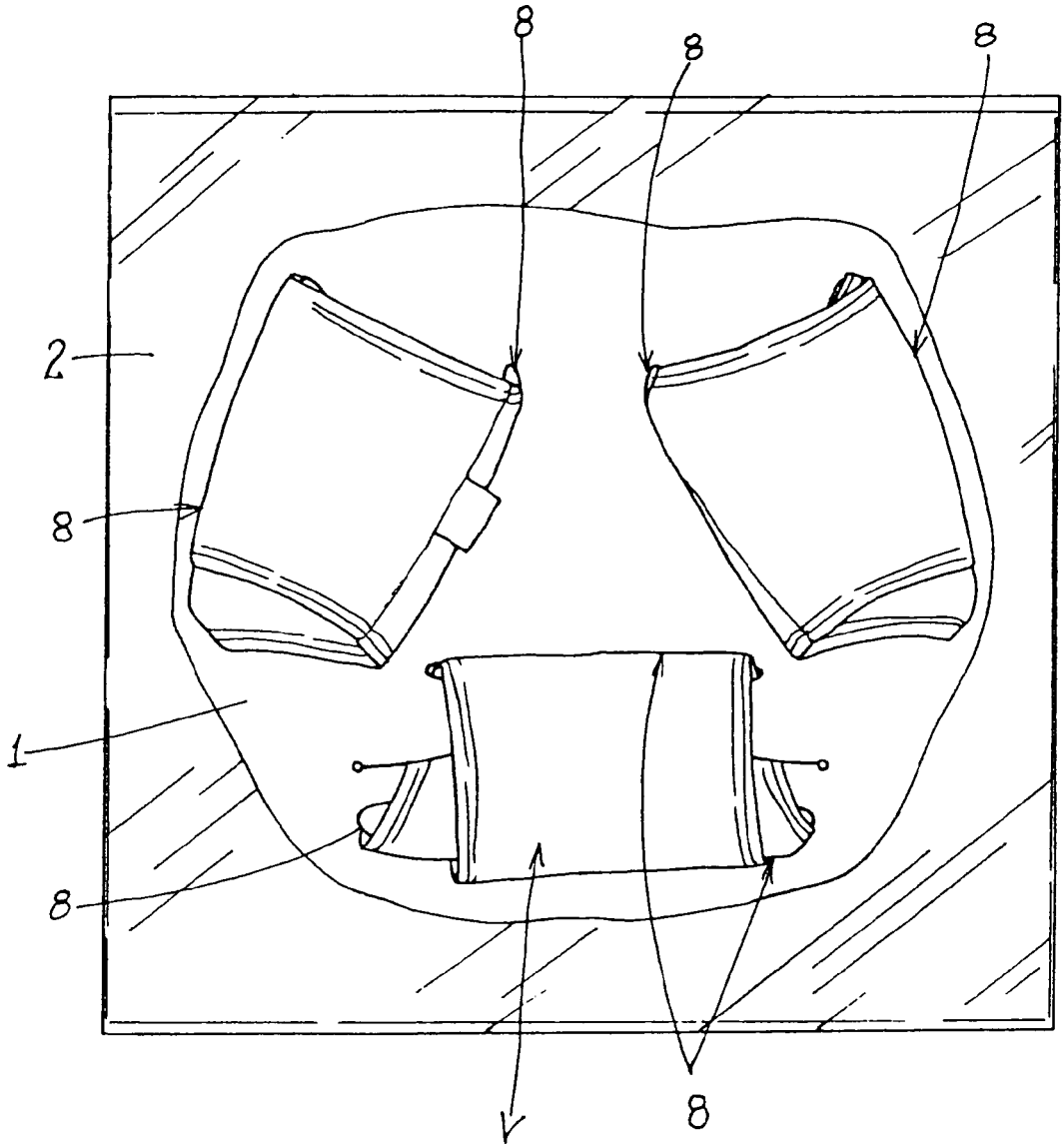
FIG. 3 shows a rear view of this package, with its plastic cover shown in partial section.

Cardboard 1 is divided into two sections 3, and each section can be folded over the other along a folding line 4, as can be seen in FIGS. 1 and 2.

The cardboard's sections 3 define a top cover 5 and a lower back cover 6, the lower back cover 6 having a set of cutouts 7 made in such a way as to create openings 8 for introducing and fastening the two sides of the underwear V, including its mid-lower part. The clothing mentioned can be a panty, such as in the example shown, but it can also be a man's underpants or similar item.

The clothing item V is therefore arranged in a way that most of it is visible.

Once the clothing item V is placed on the cardboard 1, said cardboard is assembled inside the plastic cover 2, as can be better seen in FIG. 2.

The plastic cover 2 is developed in such a way as to almost entirely cover both surfaces (inner and outer) of each of the sections 3.

The clothing item packed in this way is partially hidden until the top cover 5 is opened like a greeting card.

Actually, the packaging discussed herein allows the product packed in it (panties, men's underpants and the like) to make up a product (package as a whole together with the clothing item itself) that can be given as a greeting card and a gift at the same time.

Therefore, the inner side of the top cover 5 can be used to write a dedicatory message D addressed to whoever will receive the product packed in the packaging, i.e., the clothing item V, as a gift.

What is claimed is:

1. A constructive device for packaging underwear comprising a cardboard or a laminate; and a plastic cover that envelops the cardboard including an underwear fixed to the cardboard; the cardboard is divided into two sections which are configured to fold along a folding line; the sections of the cardboard comprise a top cover and a lower back cover, the lower back cover includes a set of cutouts that create openings for introducing and fastening sides of the underwear, including the mid-lower part, of the underwear; said cardboard being inside the plastic cover, which substantially covers inner and outer surfaces of each of the sections.

* * * * *